US006558134B2

(12) United States Patent
Serafin et al.

(10) Patent No.: US 6,558,134 B2
(45) Date of Patent: May 6, 2003

(54) FLUID INTENSIFIER PUMP SYSTEM

(75) Inventors: Mark Serafin, Apple Valley, MN (US); LeRoy C. Erickson, Blaine, MN (US)

(73) Assignee: Imation Corp., Oakdale, MN (US)

( * ) Notice: Subject to any disclaimer, the term of this patent is extended or adjusted under 35 U.S.C. 154(b) by 4 days.

(21) Appl. No.: 09/917,299

(22) Filed: Jul. 27, 2001

(65) Prior Publication Data

US 2003/0021700 A1 Jan. 30, 2003

(51) Int. Cl.[7] ..... F04B 25/00; F04B 3/00; F04B 17/00; F04B 11/00; F04B 19/24

(52) U.S. Cl. ..... 417/246; 417/244; 417/400; 417/401; 417/539; 417/53

(58) Field of Search ..... 417/244, 246, 417/254, 400, 401, 539, 53

(56) References Cited

U.S. PATENT DOCUMENTS

| | | | | |
|---|---|---|---|---|
| 2,463,552 A | * | 3/1949 | Newhall | 417/345 |
| 2,819,835 A | | 1/1958 | Newhall | |
| 3,234,882 A | | 2/1966 | Douglas et al. | |
| 4,412,792 A | | 11/1983 | LaBorde et al. | |
| 4,435,133 A | | 3/1984 | Meulendyk | |
| 4,527,954 A | | 7/1985 | Murali et al. | |
| 4,533,254 A | | 8/1985 | Cook et al. | |
| 4,701,112 A | | 10/1987 | Eisenhut et al. | |
| 5,241,986 A | | 9/1993 | Yie | |
| 5,482,077 A | | 1/1996 | Serafin | |
| 5,507,624 A | | 4/1996 | Fehn | |
| 5,584,664 A | * | 12/1996 | Elliott et al. | 222/3 |
| 5,852,076 A | | 12/1998 | Serafin et al. | |
| 5,863,186 A | * | 1/1999 | Green et al. | 417/244 |
| 5,865,029 A | * | 2/1999 | Brieschke | 60/560 |
| 5,879,137 A | | 3/1999 | Yie | |
| 6,135,069 A | | 10/2000 | Fenelon et al. | |

FOREIGN PATENT DOCUMENTS

| | | |
|---|---|---|
| EP | 0 792 194 B1 | 9/1997 |
| WO | WO 92/22748 | 12/1992 |

OTHER PUBLICATIONS

Huisman H.F., "Dispersion of (Magnetic) Pigment Powders in Organic Liquids," *Journal of Coatings Technology* 57(727): 49–56 (1985).

Winkler J. et al., "Theory for the Deagglomeration of Pigment Clusters in Dispersion Machinery by Mechanical Forces. I," *Journal of Coatings Technology* 59(754): 35–41 (1987).

Winkler J. et al., "Theory for the Deagglomeration of Pigment Clusters in Dispersion Machinery by Mechanical Forces. II," *Journal of Coatings Technology* 59(754): 45–53 (1987).

Winkler J. et al., "Theory for the Deagglomeration of Pigment Clusters in Dispersion Machinery by Mechanical Forces. III," *Journal of Coatings Technology* 59(754): 55–60 (1987).

* cited by examiner

*Primary Examiner*—Charles G. Freay
*Assistant Examiner*—Timothy P. Solak
(74) *Attorney, Agent, or Firm*—Eric D. Levinson

(57) ABSTRACT

An intensifier pump system includes a supply pump for delivering fluid products at an intermediate pressure. The products are delivered to one or more intensifier pumps that take advantage of hydraulic intensification to expel the product at high pressures to assure continuous product deployment in various systems. After an extension cycle in one of the intensifier pumps, product is delivered from the supply pump at a pressure sufficient to retract the intensifier pump and fill the chamber with fluid.

41 Claims, 4 Drawing Sheets

FLUID INTENSIFIER PUMP SYSTEM

TECHNICAL FIELD

The present invention relates to fluid pumping and, more particularly, to intensifier pumping.

BACKGROUND

Hydraulic intensifier pumps are widely used in applications requiring the delivery of a high pressure jet of fluid. An intensifier pump includes a pump cylinder, a hydraulic working piston, a product intensifier piston, inlets for the hydraulic working fluid to both advance and retract the piston, an inlet for the product fluid to be pressurized, and an outlet for the pressurized fluid. In operation, lower pressure hydraulic fluid is applied to the comparatively large working piston. The working piston, in turn, drives the smaller intensifier piston. The ratio of the hydraulic and product piston areas is the intensification ratio. The hydraulic pressure is multiplied by the intensification ratio to produce an increase in pressure.

The fluid to be intensified typically is delivered to the intensifier via an inlet check valve from a low pressure fluid supply pump. The fluid supply pump generally is able to generate sufficient pressure to overcome the tension of an internal poppet spring within the check valve, opening the check valve when the intensifier is in the retraction cycle and allowing product fluid to be delivered to the intensifier cylinder. When the piston begins its advance cycle to expel the pressurized fluid, the higher pressure of the intensified product fluid overcomes the lower supply pressure, closing the inlet check valve and thereby preventing backflow of the intensified fluid into the low pressure supply side of the pump. Many intensifier systems incorporate two or more intensifier pumps that advance and retract on an alternating basis to provide a substantially continuous fluid jet. When one product intensifier piston retracts, the other advances. The relative timing of the advance and retraction cycles is carefully controlled to provide a substantially constant fluid pressure.

For industrial applications requiring precise fluid delivery, pressure fluctuation can be highly undesirable. For example, in processing of dispersions, emulsions, liposomes, and the like, the total amount of work, or energy, being applied is a function of both the mechanical power, or shear, and the time the product is in the shear zone. Further, in order to effectively process dispersions, the energy level must be sufficiently high and uniform to disperse agglomerate structure. A gradient of energy levels being applied to a dispersion, as a result of the processes having pulsation, will result in some of the product being subjected to insufficient processing. Continued processing of the product, under conditions where pulsations exist, cannot compensate for the gradient of energy levels that is less than the energy level required. Other applications that suffer from pulsation include the processing and pumping of coating solutions to a coating process such as a coating die where pulsation will cause product caliper variation.

Other considerations for intensifier pump systems include the overall size of the pumps, the configuration of the equipment to both advance and retract the intensifier pumps and the speed at which the intensifier pumps can be cycled. Intensifier pumps having hydraulic advance and retract cycles need to be appropriately configured, thereby increasing their overall size. Furthermore, the hydraulic retraction cycle can be relatively slow, thereby increasing the length of each cycle. For example, the intensifier pump has a hydraulic retraction cycle, during which the low pressure supply pump fills the intensifier barrel. Thus, the hydraulic retraction cycle must provide a sufficiently long period of time to allow the conventional check valves to open and the supply pump to fill the barrel. To provide this extended time period, the conventional intensifier pump has a relatively long piston length, thus increasing both the overall size of the intensifier pump and the delay imparted through the operation of the intensifier pump. Further complicating this problem is the need to precompress the product prior to advancing. That is, the intensifier pump typically must be filled to capacity and then advanced to a point where the product is raised to a predetermined pressure. Only then is the outlet opened and the product is delivered at pressure. These processes further increase the cycle time of the intensifier

SUMMARY

The present invention is generally directed to a hydraulic intensifier system useful in the delivery of fluid material under pressure. The intensifier system gains efficiencies through the use of a charge intensifier pump that delivers a supply of material under a relatively high pressure to one or more product intensifier pumps. The charge intensifier pump functions at a pressure level sufficient to cause a piston in a receiving product intensifier pump to retract, thus allowing the product intensifier pump barrel to fill with product. After filling, the charge intensifier pump can continue to increase the pressure within the filled product intensifier pump barrel, thus reducing the amount of preloading required by the product intensifier pump prior to beginning its advance cycle.

A system and method, in accordance with the present invention, preferably make use of a low pressure supply pump to deliver material into the system. The low pressure supply pump feeds into a charge intensifier pump through a controllable check valve. The charge intensifier pump then delivers the material at a much higher pressure to one of multiple product intensifier pumps. The product intensifier pumps are configured so that some of the pumps are essentially out of phase with one another. That is, in a system having two product intensifier pumps, one is advancing (and hence delivering product) while the other is retracting and preloading. During the retraction of the product intensifier pump, it is being filled with product so that during a subsequent advance stroke, material is expelled.

At the end of an advance cycle, material is allowed to enter the product intensifier pump from the charge intensifier pump. The material is delivered at a relatively high pressure that is sufficient to cause the product intensifier pump to retract at a relatively high speed. Thus, the charge intensifier pump can increase the speed of the retraction stroke of the product intensifier pump. The charge intensifier pump has a larger product displacement per stroke than that of the product intensifier pumps. Thus, the charge intensifier pump fully fills one (or more) of the product intensifier pumps with each stroke. Furthermore, the charge intensifier pump fills the product intensifier pumps without introducing air, thus aiding in the control and elimination of pulsation. Even after fully retracting, material is still delivered from the charge intensifier pump to the barrel of the product intensifier pump, causing the material within the product intensifier pump to further increase in pressure. This reduces the amount of time the product intensifier pump will need to preload or precompress the material before the advance stroke begins to deliver product. The product intensifier pump then begins its advance cycle, delivering product. At or near the same time, the other product intensifier pump (in a two product pump system) is retracted by the delivery of product from the charge intensifier pump.

In this manner, material is substantially constantly and consistently delivered by the product intensifier pumps. The product intensifier pump pistons are retracted quickly with the aid of the charge intensifier pump. The preload period is greatly reduced. Thus, efficiency is increased through a reduction in the required time duration for each cycle. Further, because the charge intensifier pump causes the retraction of each of the product intensifier pumps, there is no need to provide a hydraulic retraction cycle for any of the product intensifier pumps. Rather, in some embodiments, the hardware and fittings necessary for delivery of working fluid for retraction can be eliminated. Thus, the complexity of the product intensifier pumps is reduced, making them more efficient and cost effective.

Various sensors can be positioned to determine the position of each of the pistons in the product intensifier pumps and the charge intensifier pump. The output of these sensors is provided to a number of controllers. The controllers actively control the functioning of a number of check valves located throughout the system, referred to herein as "smart" valves. In summary, smart valves are actively controllable valves that can be opened and closed through the use of an actuator that is coupled with the controller. The present system gains further efficiencies because of the use of the sensors in conjunction with the controller. That is, the controller can determine (through sensor data) when a particular intensifier pump is at or near the end of a cycle. The controller can then open or close the appropriate smart valve or valves in anticipation of the completion of this cycle.

The details of one or more embodiments of the present invention are set forth in the accompanying drawings and the description below. Other features, objects, and advantages of the present invention will be apparent from the description and drawings, and from the claims.

DESCRIPTION OF DRAWINGS

Like reference numbers and designations in the various drawings indicate like elements.

DETAILED DESCRIPTION

Figure 1:
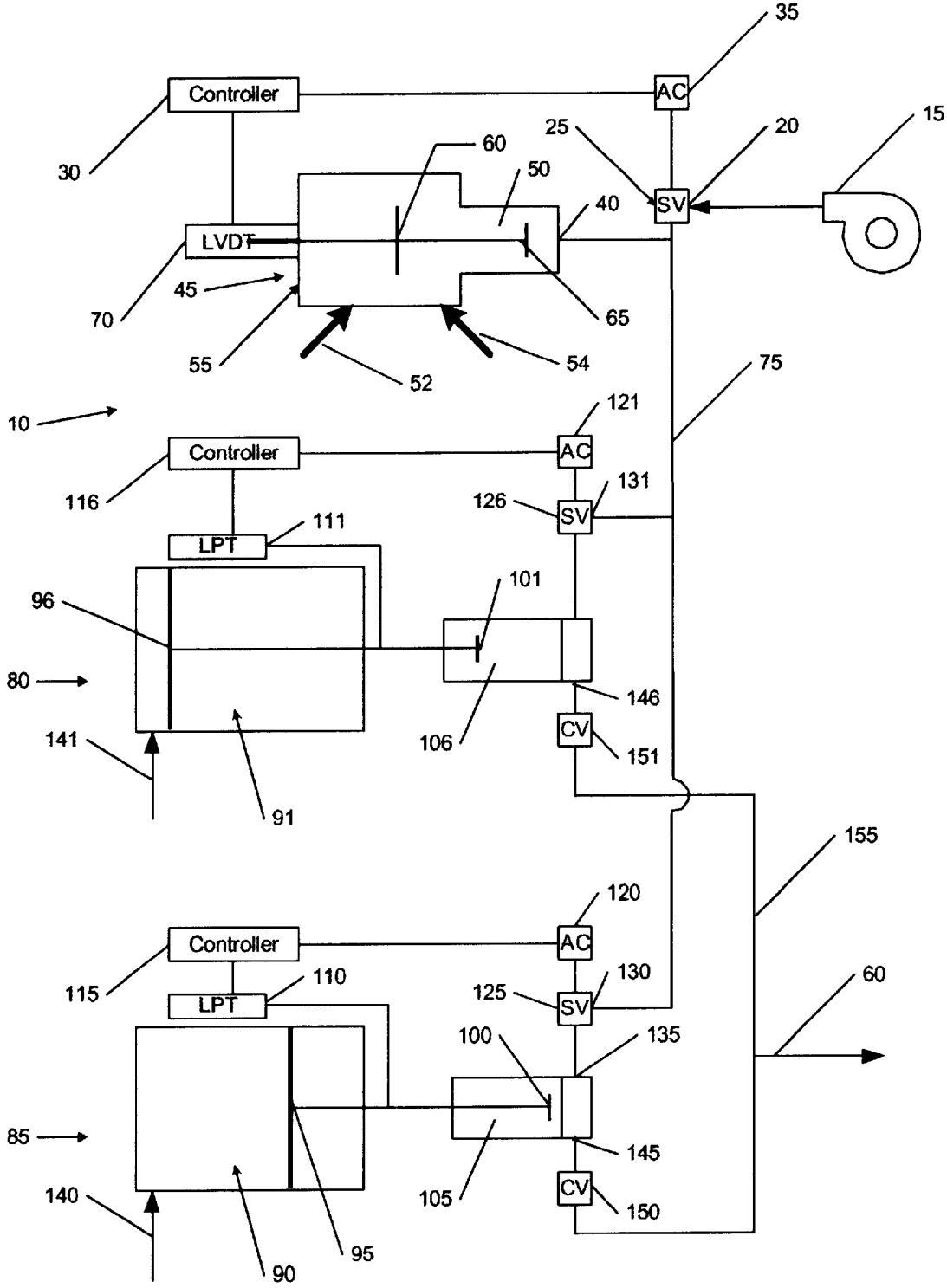
FIG. 1 is a diagram of a hydraulic intensifier system.

FIG. 1 is a diagram of a hydraulic intensifier system 10 in accordance with an embodiment of the present invention. Intensifier system 10 may be particularly useful in the delivery of a continuous, steady, high pressure flow of pigmented dispersions where avoidance of significant pressure fluctuation is desirable. An example application is the delivery of coating compositions for manufacture of magnetic data storage media. In such an application, intensifier system 10 may be used to deliver pigmented dispersions having abrasive materials with particles that range from submicron sizes to sizes that exceed those captured by a 60 mesh screen, at throughputs exceeding 0.1 gpm to greater than 2 gpm, and for periods of time exceeding 100 hours of operation. Typical fluid pressure may range from 0 psi to 40,000 psi (276,000 kilopascals), or greater, during each intensifier cycle.

Hydraulic intensifier system 10 includes a low pressure supply pump 15. Supply pump 15 is used to deliver material into intensifier system 10 from a supply or reservoir, not separately shown. Supply pump 15 may be a diaphragm pump, or other suitable pump, capable of delivering an appropriate volume of material. Supply pump 10 will generally deliver material at about 60–100 psi, tough this can vary from system to system.

Supply pump 15 feeds into inlet 20 of a check valve, hereinafter referred to as a "smart" valve 25. Smart valve 25 is a controllable valve that can be actively opened and closed by a controller 30. Smart valve 25 includes a valve poppet (not shown) that is coupled to an actuator (not shown) that is in turn coupled to air cylinder 35. Air cylinder 35 is controlled by controller 30 and can quickly and efficiently open or close smart valve 25 through the actuation of the valve poppet. An example of a suitable valve is disclosed in U.S. patent application Ser. No. 09/363,400, the entire content of which is incorporated herein by reference.

When smart valve 25 is opened, material is delivered through inlet/outlet 40 of a charge intensifier pump 45. More specifically, material is delivered into an intensifier barrel 50. Charge intensifier pump 45 includes a hydraulic actuator 55 having a hydraulic piston 60. As hydraulic piston 60 is caused to move back and forth, it causes product intensifier piston 65 to move back and forth as well. More specifically, as hydraulic piston 60 and product intensifier piston 65 retract, material is able to fill intensifier barrel 50. As, hydraulic piston 60 advances, product intensifier piston 65 advances and material is expelled through inlet/outlet 40 at the appropriate intensified pressure. Hydraulic piston 60 is caused to advance by introducing hydraulic fluid under pressure through hydraulic fluid supply inlet (advance) 52 and retracted by introducing hydraulic fluid under pressure through hydraulic fluid supply inlet (retract) 54. An LVDT 70 (linear variable displacement transducer) is coupled with hydraulic piston 60 so as to provide an indication of the piston's position to controller 30. Thus, controller 30 causes smart valve 25 to open when hydraulic piston 60 is ready to begin its retraction cycle.

Each time supply intensifier piston 65 advances, material is moved through inlet/outlet 40 at a relatively high pressure into supply line 75. While actual pressures will vary depending upon the configuration of the system, in one embodiment the material enters the supply line at between 700–2000 psi (4830–13,800 Kilo Pascals). Material is then delivered to either a first product intensifier pump 80 or a second product intensifier pump 85 (each of which has the same components in the same configuration). It should be noted that more product intensifier pumps could be incorporated into the system and the illustrated embodiment having two such pumps is for illustrative purposes only. As illustrated, first product intensifier pump 80 is in a retracted position when second product intensifier pump 85 is at or near the end of an extension cycle. In this manner, first and second products intensifier pumps 80, 85 operate out of phase with one another to provide a combined output that is substantially continuous and constant.

Second product intensifier pump 85 includes a hydraulic actuator 90 having a hydraulic piston 95. Hydraulic piston 95 is coupled to a product intensifier piston 100 located within an intensifier barrel 105. A linear position transmitter (LPT) 110 is coupled between hydraulic piston 95 and a controller 115 so as to provide positional information to controller 115. Controller 115 may be coupled with an air cylinder 120 that actuates smart valve 125.

As hydraulic piston 95 reaches the end of its extension cycle, information indicative of this position is sent by LPT 110 to controller 115. Controller 115 then causes smart valve 125 to open. Material enters inlet 130 of smart valve 125, passes therethrough and enters an inlet 135 of intensifier barrel 105. Because the material may be delivered at pressures of about 1200 psi (8270 kilopascals) by charge intensifier pump 45, product intensifier piston 100 is forced backwards (in retraction) at a relatively high speed, also forcing hydraulic piston 95 to retract. This eliminates the need to provide a mechanism to hydraulically retract piston 95, such as a hydraulic fluid inlet. LPT 110 registers when hydraulic piston 95 has fully retracted and this data is passed to controller 115. Charge intensifier pump 45 has a larger product displacement per stroke than that of second product intensifier pump 85. Thus, charge intensifier pump 45 fully fills intensifier barrel 105 with each stroke. Furthermore, charge intensifier pump 45 fills intensifier barrel 105 without introducing air, thus aiding in the control and elimination of pulsation. Controller 115 can be configured to not immediately close smart valve 125. Instead, smart valve 125 may remain open for a predetermined period of time to permit preloading. The material continues to be delivered by charge intensifier pump 45, thus raising the pressure within intensifier barrel 105. In one embodiment, the pressure within intensifier barrel 105 is caused to increase to between 1600–1700 psi (11,000–11,700 kilopascals). At the appropriate time, controller 115 then causes smart valve 125 to close.

Hydraulic fluid supply 140 is then caused to deliver hydraulic fluid under pressure into hydraulic actuator 90. This, in turn causes hydraulic piston 90 to advance, which causes product intensifier piston 100 to advance. Normally, there would be a precompression phase where the material within intensifier barrel 105 is caused to increase in pressure before it is expelled. However, this phase has been greatly reduced or eliminated by bringing this material to or near this pressure level via the material introduced by charge intensifier pump 45. Of course, the desired output pressure will be determinative of whether the pressures achieved by charge intensifier pump 45 are sufficient for preloading. As product intensifier piston 100 advances, it forces material through outlet 145 and causes check valve 150 to open. At the same time, smart valves 125, 126 prevent backflow of the material through fluid line 75. Material is then delivered, at pressure, to output line 155 where it becomes intensified product outflow 160. At this point, the product is then utilized in the appropriate process. In one embodiment, product intensifier pumps 80, 85 can deliver material at pressures up to or exceeding 40,000 psi (276,000 kilopascals).

As product intensifier piston 100 reaches the end of its extension cycle, smart valve 125 is again opened and the process in repeated. Likewise, the same process is occurring with first product intensifier pump 80. Specifically, like product intensifier pump 85, first product intensifier pump 80 includes a hydraulic actuator 91 having a hydraulic piston 96. Hydraulic piston 96 is coupled to a product intensifier piston 101 located within an intensifier barrel 106. A linear position transmitter (LPT) 111 is coupled between hydraulic piston 96 and a controller 116 so as to provide positional information to controller 116. The position of LPT 111 can vary and still produced the same data. That is, LPT 111 could be located anywhere along hydraulic piston 96 or intensifier piston 101. Controller 116 is coupled with an air cylinder 121 that actuates smart valve 126.

As hydraulic piston 96 reaches the end of its extension cycle, information indicative of this position is sent by LPT 111 to controller 116. Controller 116 then causes smart valve 126 to open. Material enters inlet 131 of smart valve 126, passes therethrough and enters an inlet 136 of intensifier barrel 106. Because the material may be delivered at pressures of about 1200 psi (depending upon the actual configuration of the system) by charge intensifier pump 45, product intensifier piston 101 is rapidly forced backwards (in retraction), also forcing hydraulic piston 96 to retract. LPT 111 registers when hydraulic piston 96 has fully retracted and this data is passed to controller 115. This is the position illustrated in FIG. 1.

Hydraulic fluid supply 141 is then caused to deliver hydraulic fluid under pressure into hydraulic actuator 91. This, in turn, causes hydraulic piston 91 to advance which causes product intensifier piston 101 to advance. As product intensifier piston 101 advances, it forces material through outlet 146 and causes check valve 151 to open. Material is then delivered, at pressure, to output line 155 where it becomes intensified product outflow 160. At this point, the product is then utilized in the appropriate process. Thus, first product intensifier pump 80 and second product intensifier pump are configured so that one is always delivering product while the other is retracting. In this manner, consistent and even intensified product outflow 160 is achieved.

Figure 2:
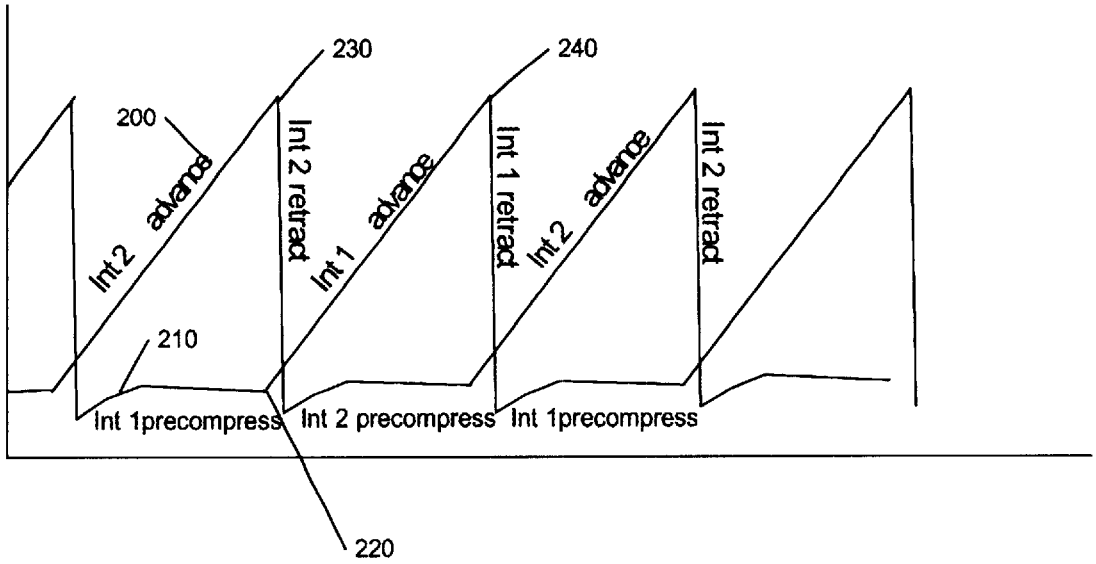
FIG. 2 is a graph indicating the advance and retraction cycles of a pair of product intensifier pumps.

FIG. 2 is a graph illustrating the relative position (as sensed by LPT's 110, 111) of hydraulic pistons 96, 96 in first and second product intensifier pumps 80,85 over time. As illustrated, first and second product intensifier pumps 80, 85 are complementary to one another. That is, as one retracts, the other advances and preloads. At 200, second product intensifier pump 85 is advancing. At the same time, first product intensifier pump 85 is preloading as illustrated at 210. At 220, first product intensifier pump 80 begins advancing. A short time later at 230, second product intensifier pump 85 begins retracting. Thus, there is some overlap where both are advancing at the same time. This assures a consistent and uniform material output. First product intensifier pump 80 continues to advance until 240 where it then begins to retract. The retraction cycle is accomplished very quickly by applying the fluid output of charge intensifier pump 45 to rapidly retract the appropriate product intensifier piston 100, 101.

Figure 2A:
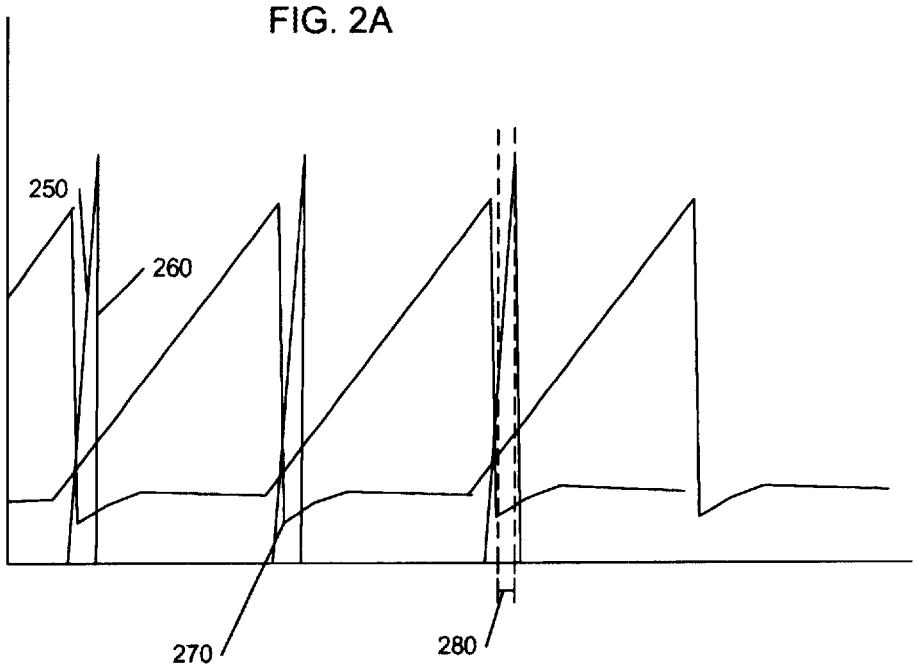
FIG. 2A is the graph of FIG. 2 with an overlay of the advance and retraction cycles of a charge intensifier pump.

FIG. 2A is a graph illustrating the same data shown in FIG. 2. In addition, a plot of the position of charge intensifier pump 45 is overlaid. Charge intensifier pump 45 has an advance cycle 250 and a retraction cycle 260. After the relevant product intensifier pump 80, 85 has been fully retracted at 270, charge intensifier pump 45 continues to advance for a short period of time as indicated by 280. During this time, the pressure of the material within intensifier barrel 105, 106 is being increased. This minimizes the amount of time required by product intensifier piston 100, 101 to preload the material prior to dispensing the material. In other words, precompression or preloading is actually occurring at the end of the retraction cycle. Product intensifier pistons 100, 101 complete the preloading cycle by bringing the internal pressure up to a target level (if necessary).

Through the use of the present system, various advantages can be realized. For example, the retraction cycle of the present invention occurs much more rapidly than in existing systems. Thus, the stroke length of the product intensifier piston 100, 101 can be reduced allowing the overall system to become smaller. Size is further reduced due to the elimination of the hydraulic retraction cycle in intensifier pumps 80, 85 and the equipment associated therewith. Because the retraction cycle terminates with pressurized material in intensifier barrels 105, 106, valve actuation can be made nearly instantaneous upon commencement of the preload and advance cycle. Similarly, because preloading commences during the retraction cycle and is rapid during this time, the target pressure for the intensifiers can be reached more quickly. Finally, the system and process of the present invention assure that intensifier barrels 105, 106 are fully filled with material at the end of the retraction cycle.

Figure 3:
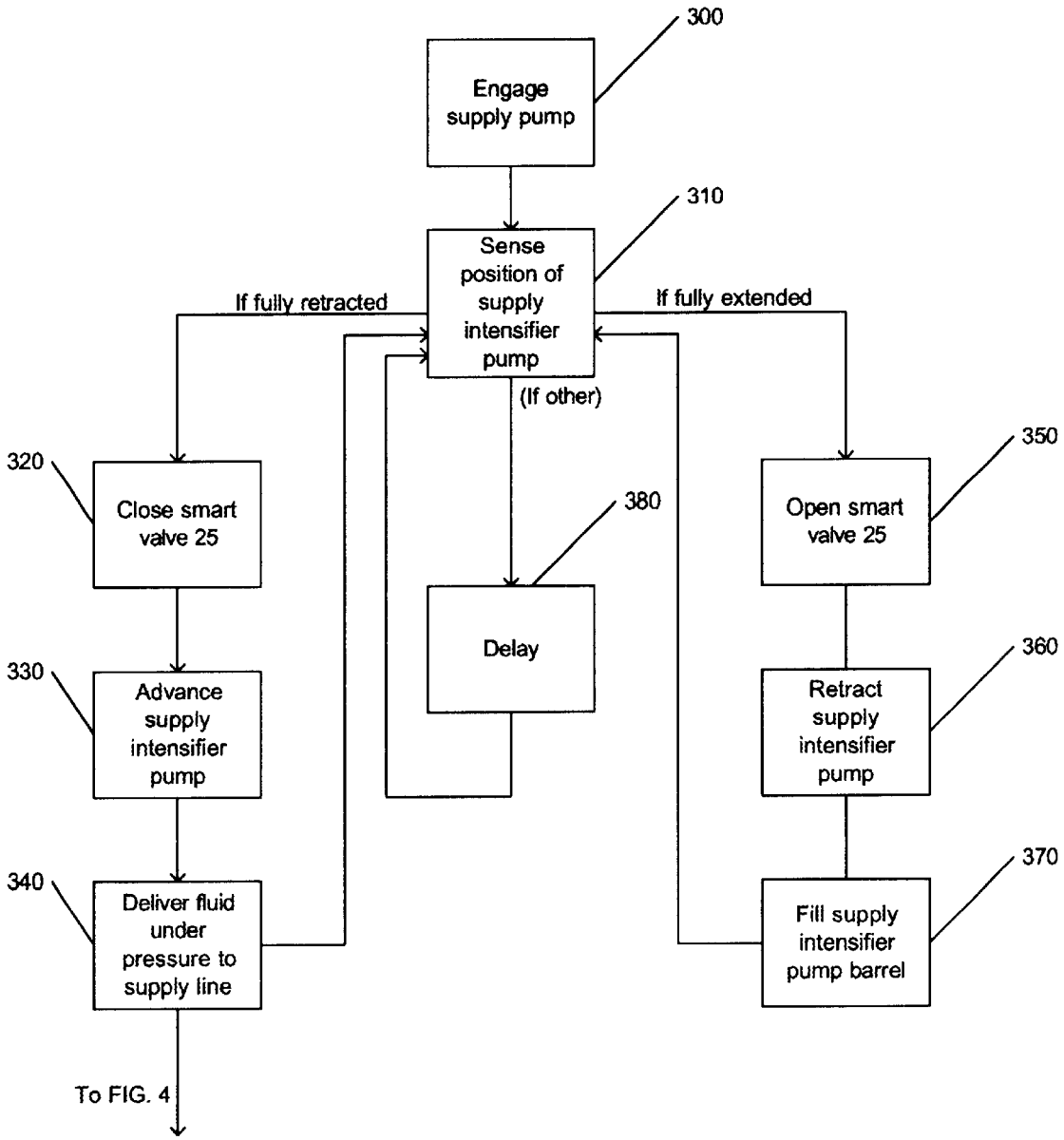
FIG. 3 is a flow chart illustrating the process that a charge pump and charge intensifier pump follow in delivering materials at pressure.

FIG. 3 is a flow chart illustrating the process that supply pump 15 and charge intensifier pump 45 may follow. Initially, supply pump 15 is engaged (300) so as to deliver material, such as the fluids described above, to the system. Supply pump 15 delivers this material to intensifier barrel 50 of charge intensifier pump 45. The position of actuator 55 is sensed (310) by an appropriate sensor, such as LVDT 70. If it is determined that actuator 55 is fully retracted, material flow from supply pump 15 is interrupted by closing smart valve 25 (320) via controller 30. Actuator 55 is then advanced (330), thus causing the material to be expelled into supply line 75 at the appropriate pressure level (340).

If actuator 55 is fully extended when its position is sensed (310), smart valve 25 is opened via controller 30 and material is allowed to enter intensifier barrel 50. Actuator 55 is then hydraulically retracted (360) to allow intensifier barrel 50 to fill (370) with material. The hydraulic retraction of actuator 55 can begin prior to, concurrently with, or after smart valve 25 has been opened.

The position of actuator 55 is repeatedly sensed (310). The actions described above can be set to occur precisely at or close to the end of an extension stroke or a retraction stroke, depending upon what performance characteristics are desired. If during one of these repetitive sensings (310), actuator 55 is neither at the determined extended or retracted position, i.e., it is in the middle or in the process of either stroke, no additional action is taken (380) and sensing continues (310).

Figure 4:
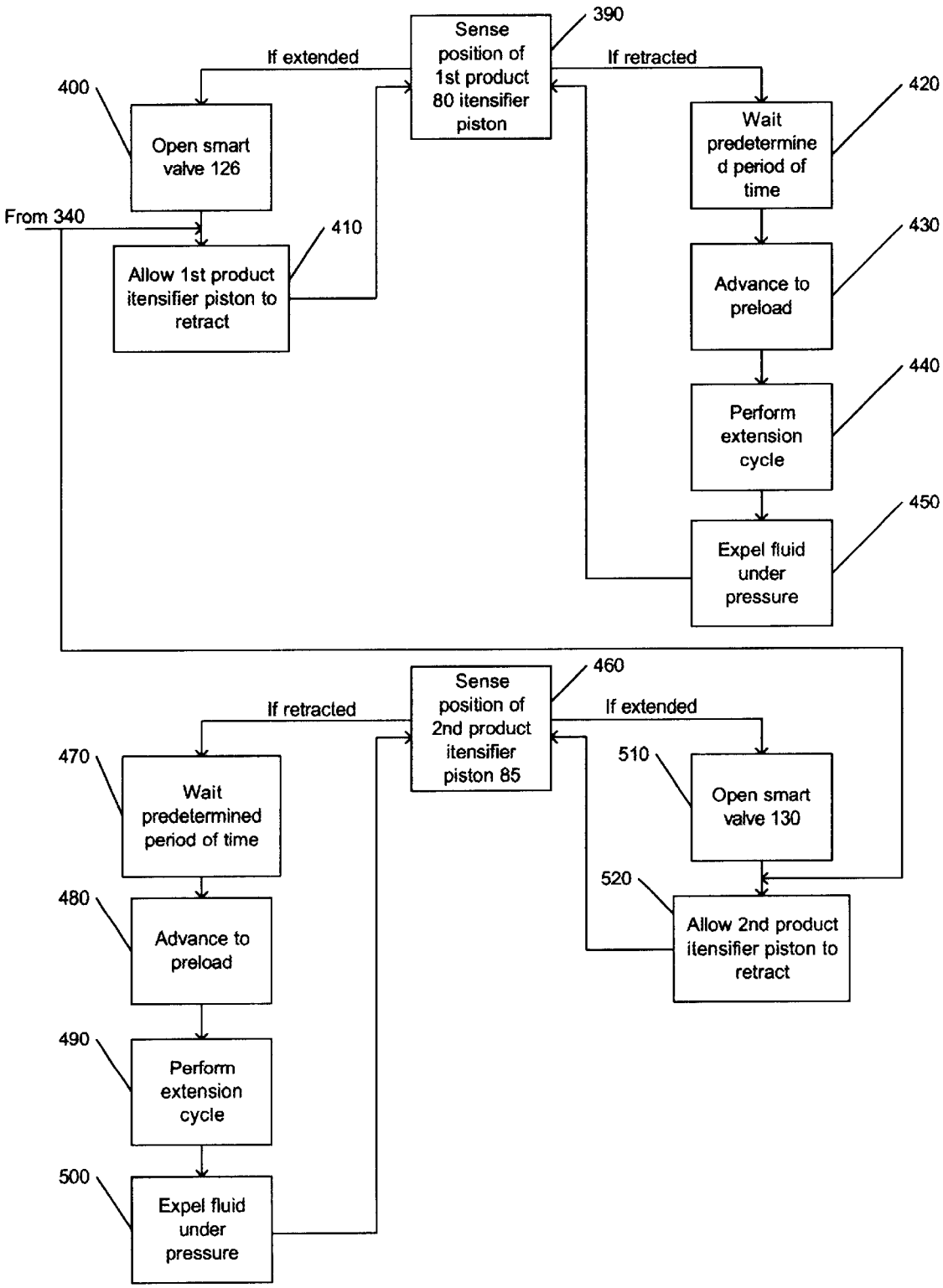
FIG. 4 is a flow chart illustrating the process that a pair of product intensifier pumps will follow when coupled to a charge intensifier pump.

FIG. 4 is a flowchart illustrating the operation of product intensifier pumps 80, 85. An appropriate sensor, such as LPT 111, senses the position of piston 96 (300). If piston 96 is fully extended, smart valve 126 is opened (400). It is to be understood that fully extended means that piston 96 is at or near the end of its advance cycle. This includes positions just prior to completing a full advance stroke, completing the full advance stroke, and the initial period of retraction just after completing a full advance stroke. The exact position at which sensor 111 will indicated that piston 96 is fully extended will depend upon the desired operating parameters of the system. Once smart valve 126 has been opened (400), material under pressure enters intensifier barrel 106 from supply line 75. More specifically, charge intensifier pump 45 delivers the material under pressure (340—FIG. 3). The delivery of this material under pressure causes piston 96 to fully retract (410) without the use of a separate hydraulic retraction mechanism.

The position of piston 96 continues to be sensed (390). When it is determined that piston 96 has been fully retracted, smart valve 126 remains open for an additional predetermined period of time (420). Thus, as charge intensifier pump 45 continues to deliver material, the pressure within intensifier barrel 106 increases. Alternatively, smart valve 126 remains open until a predetermined pressure is measured, rather than waiting for a predetermined period of time.

After the predetermined period of time has expired, smart valve 126 is closed and piston 96 is hydraulically caused to advance (430). Initially, this may be done to preload the material and thus raise it to an even higher pressure (if necessary). Piston 96 is caused to perform an extension cycle (440) where material is expelled from product intensifier piston 80 at the appropriate pressure levels (450).

Similarly, product intensifier piston 85 performs the same functions, but at different times so that the two product intensifier pistons 80, 85 together achieve a smooth and continuous product outflow. An appropriate sensor, such as LPT 110 senses the position of piston 95 (460). If piston 95 is fully extended, smart valve 125 is opened (510). It is to be understood that fully extended means that piston 95 is at or near the end of its extension cycle. This includes positions just prior to completing a full extension, completing the full extension, and the initial period of retraction just after completing a full extension. The exact position at which sensor 110 will indicate that piston 95 is fully extended will depend upon the desired operating parameters of the system. Once smart valve 125 has been opened (510), material under pressure enters intensifier barrel 106 from supply line 75. More specifically, charge intensifier pump 45 delivers the material under pressure (340—FIG. 3). The delivery of this material under pressure causes piston 95 to fully retract (520) without the use of a separate hydraulic retraction mechanism.

The position of piston 95 continues to be sensed (460). When it is determined that piston 95 has been fully retracted, smart valve 125 is caused to remain open for an additional predetermined period of time (470). Thus, as material continues to be delivered from charge intensifier pump 45, the pressure within intensifier barrel 105 is caused to increase. Alternatively, smart valve 125 is caused to remain open until a predetermined pressure is measured, rather than waiting for a predetermined period of time.

After the predetermined period of time has expired, smart valve 125 is closed and piston 95 is hydraulically caused to advance (480). Initially, this may be done to preload the material and thus raise it to an even higher pressure (if necessary). Piston 95 is caused to perform an extension cycle (490) where material is expelled from product intensifier piston 85 at the appropriate pressure levels (500).

A number of embodiments of the present invention have been described. Nevertheless, it will be understood that various modifications may be made without departing from the spirit and scope of the invention. Accordingly, other embodiments are within the scope of the following claims. For example, the number of product intensifier pumps being utilized can vary depending upon the desired output of the system. Thus a single product intensifier pump or any number working together can be utilized. Any number of controllers could be utilized, with a single controller replacing multiple illustrated controllers if desired. Furthermore, as the number of product intensifier pumps increases, it may be desirable to also include additional charge intensifier pumps, again depending upon the specifics of the system in question. In addition, it is not required that the charge intensifier pump act to precompress the material within the product intensifier pump in order to realize the benefits and advantages of the present invention.

What is claimed is:

1. An intensifier pump system for the delivery of material, the pump system comprising:

a supply pump that delivers material to the system;

a first intensifier pump that receives the material front the supply pump;

a second intensifier pump coupled to the first intensifier pump so that material delivered under pressure from the first intensifier pump to the second intensifier pump causes the second intensifier pump to refract and fills a first intensifier barrel associated with the second intensifier pump with the material;

a first controllable valve that selectively delivers the material from the supply pump to the first intensifier pump when the first controllable valve is open;

a first sensor that determines a position of an actuator within the first intensifier pump; and a first controller that opens the first controllable valve when an output of the first sensor indicates the actuator is near the end of an advance cycle and closes the first controllable valve when the output of the first sensor indicates the actuator is near the end of a retraction cycle.

2. The intensifier pump system of claim 1, wherein the first sensor is a linear variable displacement transducer.

3. The intensifier pump system of claim 1, further comprising:

a first hydraulic fluid input coupled with the first intensifier pump to deliver hydraulic fluid that causes the actuator to advance; and a second hydraulic fluid input coupled with the first intensifier pump to deliver hydraulic fluid that causes the actuator to retract.

4. The intensifier pump system of claim 1, wherein the material is selected from the group consisting of dispersions, emulsions, and liposomes.

5. An intensifier pump system for the delivery of material, the pump system comprising:

a supply pump that delivers material to the system;

a first intensifier pump that receives the material from the supply pump;

a second intensifier pump coupled to the first intensifier pump so that material delivered under pressure from the first intensifier pump to the second intensifier pump causes the second intensifier pump to refract and fills a first intensifier barrel associated with the second intensifier pump with the material;

a first controllable valve coupled between the first intensifier pump and the second intensifier pump so that material is delivered from the first intensifier pump to the second intensifier pump only when the first controllable valve is open;

a first sensor coupled with the second intensifier pump, wherein the first sensor determines a position of a first actuator within the second intensifier pump; and a first controller coupled with the first controllable valve and the first sensor and configured to open the first controllable valve when an output of the first sensor indicates the first actuator is near the end of an extension cycle and to close the first controllable valve when the output of the first sensor indicates the first actuator is at the end of a retraction cycle.

6. The intensifier pump system of claim 5, wherein the first sensor is a linear position transmitter.

7. The intensifier pump system of claim 5, wherein the first controller causes the first controllable valve to remain open beyond the end of the retraction cycle of the first actuator for a predetermined period of time in order to increase the pressure of the material within the first intensifier barrel to a predetermined pressure level.

8. The intensifier pump system of claim 7, wherein the predetermined pressure level is in the range of about 1200 to 1700 psi.

9. The intensifier pump system of claim 7, wherein the predetermined pressure level is greater than 1200 psi.

10. The intensifier pump system of claim 7, further comprising:

a first check valve coupled to an output of the second intensifier pump so that material output from the second intensifier pump at a predetermined pressure level causes the check valve to open and allows the material to enter an output line.

11. The intensifier pump system of claim 5, further comprising:

a third intensifier pump coupled to the first intensifier pump so that material delivered under pressure from the first intensifier pump to the third intensifier pump causes the third intensifier pump to refract and fills a second intensifier barrel coupled with the third intensifier pump with the material;

a second controllable valve coupled between the first intensifier pump and the third intensifier pump so that material is delivered from the first intensifier pump to the third intensifier pump only when the second controllable valve is opened;

a second sensor coupled with the third intensifier pump, wherein the second sensor determines a position of a second actuator within the third intensifier pump; and a second controller coupled with the second controllable valve and the second sensor and configured to open the second controllable valve when an output of the second sensor indicates the second actuator is near the end of an extension cycle and to close the second controllable valve when the output of the second sensor indicates the second actuator is at the end of a retraction cycle.

12. The intensifier pump system of claim 11, wherein the material is selected from the group consisting of dispersions, emulsions, and liposomes.

13. The intensifier pump system of claim 11, further comprising:

a third controllable valve disposed between the supply pump and the first intensifier pump so that material is selectively delivered from the supply pump to the first intensifier pump when the third controllable valve is open.

14. The intensifier pump system of claim 13, further comprising:

a third sensor coupled with the first intensifier pump, wherein the third sensor determines a position of a third actuator within the first intensifier pump; and a third controller coupled with the third controllable valve and the first sensor and configured to open the third controllable valve when an output of the third sensor indicates the third actuator is near the end of an extension cycle and to close the third controllable valve when the output of the third sensor indicates the actuator is near the end of a retraction cycle.

15. The intensifier pump system of claim 14, wherein the first and second sensors are linear position transmitters and the third sensor is a linear variable displacement transducer.

16. The intensifier pump system of claim 14, further comprising:

a first hydraulic fluid input coupled with the first intensifier pump so that as hydraulic fluid is passed through the first hydraulic fluid input, the third actuator is caused to advance; and a second hydraulic fluid input coupled with the first intensifier pump so that as hydraulic fluid is passed through the second hydraulic fluid input, the third actuator is caused to retract.

17. The intensifier pump system of claim 11, wherein the second controllable valve is caused to remain open beyond the end of the retraction cycle of the second actuator for a predetermined period of time in order to increase the pressure of the material within the first intensifier barrel to a predetermined pressure level.

18. The intensifier pump system of claim 17, wherein the predetermined pressure level is in the range of about 1200–1700 psi.

19. The intensifier pump system of claim 17, wherein the predetermined pressure level is greater than 1200 psi.

20. The intensifier pump system of claim 17, wherein the second intensifier pump and the third intensifier pump are configured so that the second intensifier pump is near the end of the extension cycle when the third intensifier pump is near the end of the retraction cycle.

21. The intensifier pump system of claim 20, wherein both the extension cycle for the second intensifier pump and the extension cycle for the third intensifier pump overlap for a predetermined period of time.

22. The intensifier pump system of claim 5, wherein the material is selected from the group consisting of dispersions, emulsions, and liposomes.

23. An intensifier pump system for the delivery of viscous fluids under pressure comprising:

a supply pump for delivering fluids;

a first intensifier pump fluidly coupled to the supply pump, wherein the first intensifier pump is hydraulically extendable and hydraulically retractable;

a first controllable valve disposed between the supply pump and the first intensifier pump to selectively allow fluid flow from the supply pump to the first intensifier pump;

a first controller coupled to the first controllable valve and configured to open the first controllable valve when the first intensifier pump is near the end of an extension cycle and to close the first controllable valve when the first intensifier pump is near the end of a retraction cycle;

a second intensifier pump fluidly coupled to the first intensifier pump and to an outlet, wherein the second intensifier pump is hydraulically extendable;

a second controllable valve disposed between first intensifier pump and the second intensifier pump so that when the second controllable valve is opened, fluid is caused to flow from the first intensifier pump to the second intensifier pump thereby causing the second intensifier pump to retract;

a second controller coupled to the second intensifier pump and configured to open the second controllable valve when the second intensifier pump is near the end of an extension and to close the second controllable valve after the end of a retraction cycle of the second intensifier pump;

a third intensifier pump fluidly coupled to the first intensifier pump and to an outlet, wherein the third intensifier pump is hydraulically extendable;

a third controllable valve disposed between first intensifier pump and the third intensifier pump so that when the third controllable valve is opened, fluid is caused to flow from the first intensifier pump to the third intensifier pump thereby causing the third intensifier pump to retract; and a third controller coupled to the third intensifier pump and configured to open the third controllable valve when the third intensifier pump is near the end of an extension and to close the third controllable valve after the end of a retraction cycle of the third intensifier pump.

24. The system of claim 23 wherein the second controller causes the second controllable valve to remain open for a predetermined period of time after the second intensifier pump is retracted so that the pressure of the fluid within the second intensifier pump is caused to increase by the first intensifier pump.

25. The system of claim 24 wherein the third controller causes the third controllable valve to remain open for a predetermined period of time after the third intensifier pump is retracted so that the pressure of the fluid within the third intensifier pump is caused to increase by the first intensifier pump.

26. The system of claim 23 wherein the second intensifier pump and the third intensifier pump have extension cycles that partially overlap.

27. The system of claim 23, wherein the second intensifier pump and the third intensifier pump alternate between extension cycles.

28. The system of claim 27, wherein the second intensifier pump and the third intensifier pump have extension cycles that partially overlap.

29. A pumping system comprising:

a first intensifier pump having a first intensifier barrel and a first intensifier piston within the first intensifier barrel;

a second intensifier pump having a second intensifier barrel and a second intensifier piston within the second intensifier barrel; and a third intensifier pump that delivers product fluid to both the first intensifier barrel via a first fluid path and the second intensifier barrel via a second fluid path to drive each the first and second intensifier pump pistons through a retraction stroke and fill the intensifier barrels with the product fluid;

wherein the third intensifier pump delivers product fluid at a sufficiently high pressure to at least partially preload the first and second intensifier pumps.

30. The pumping system of claim 29 wherein the first intensifier piston performs advancing strokes and the second intensifier piston performs advancing strokes that alternate with the advancing strokes of the first intensifier piston.

31. The pumping system of claim 30 wherein the advancing strokes of the first intensifier piston and the second intensifier piston partially overlap.

32. An intensifier pump system comprising:

a supply pump;

a first intensifier pump coupled to receive material from the supply pump;

a second intensifier pump coupled to receive a first portion of the material under pressure from the first intensifier pump;

a third intensifier pump coupled to receive a second portion of the material under pressure from the first intensifier pump;

a first sensor that determines a position of a first actuator within the second intensifier pump;

a first controller that controls a first valve to selectively deliver the first portion of the material from the first intensifier pump to the second intensifier pump based on the position determined by the first sensor;

a second sensor that determines a position of a second actuator within the third intensifier pump; and a second controller that controls a second valve to selectively deliver the second portion of the material from the first intensifier pump to the third intensifier pump based on the position determined by the second sensor.

33. The intensifier pump system of claim 32, wherein:

the first controller controls the first valve to open when the first sensor indicates the first actuator is near the end of an advance cycle, and to close when the first sensor indicates the first actuator is near the end of a retraction cycle; and the second controller controls the second valve to open when the second sensor indicates the second actuator is near the end of an advance cycle, and to close when the second sensor indicates the second actuator is near the end of a retraction cycle.

34. A method of providing fluids at predetermined pressure levels through the use of one or more intensifier pumps, the method comprising:

sensing a position of a first actuator within a first pump, wherein the actuator is moveable between a retracted position and an extended position;

providing data about the sensed position of the first actuator to a controller that opens and closes a controllable valve;

delivering a supply of the fluid to a first pump by opening the controllable valve and allowing fluid to enter the first pump when the first actuator is near the extended position;

increasing the pressure of the fluid wit the first pump;

delivering the fluid from the first pump to a first intensifier barrel of a first intensifier pump, wherein the delivery of the fluid causes the first intensifier pump to refract and fill with fluid;

stopping delivery of the fluid from the first pump to the first intensifier pump by closing the controllable valve when the first actuator is near the retracted position;

advancing the first intensifier pump to further increase the pressure of the fluid and deliver the fluid to an output.

35. The method of claim 34, further comprising:

increasing the pressure of the fluid within the first intensifier barrel by continuing to deliver fluid from the first pump until the pressure of the fluid within the first intensifier barrel reaches a predetermined level.

36. A method of providing fluids at predetermined pressure levels through the use of one or more intensifier pumps, the method comprising:

delivering a supply of the fluid to a first pump;

increasing the pressure of the fluid with the first pump;

delivering the fluid from the first pump to a first intensifier barrel of a first intensifier pump, wherein the delivery of the fluid causes the first intensifier pump to retract and fill with fluid;

stopping delivery of the fluid from the first pump to the first intensifier pump;

advancing the first intensifier pump to further increase the pressure of the fluid and deliver the fluid to an output;

delivering the fluid from the first pump to a second intensifier barrel of a second intensifier pump, wherein the delivery of the fluid to the second intensifier barrel causes the second intensifier pump to retract and fill with fluid;

stopping delivery of the fluid from the first pump to the second intensifier pump; and advancing the second intensifier pump to further increase the pressure of the fluid and deliver the fluid to the output.

37. The method of claim 36, further comprising:

sensing a position of a first actuator within the first intensifier pump, wherein the first actuator is moveable between a retracted position and an extended position;

providing data about the sensed position of the first actuator to a first controller that opens and closes a first controllable valve;

opening the first controllable valve and allowing fluid to enter the first intensifier pump from the first pump when the first actuator is near the extended position so that the fist actuator is caused to retract; and closing the first controllable valve when the first actuator is near the retracted position.

38. The method of claim 37, further comprising:

waiting for a predetermined period of time after the first actuator is retracted before closing the controllable valve so that the pressure of the fluid within the first intensifier pump is increased.

39. The method of claim 37, further comprising:

sensing a position of a second actuator within the second intensifier pump, wherein the second actuator is moveable between a retracted position and an extended position;

providing data about the sensed position of the second actuator to a second controller that opens and closes a second controllable valve;

opening the second controllable valve and allowing fluid to enter the first intensifier pump from the first pump when the second actuator is near the extended position so that the second actuator is caused to retract; and closing the second controllable valve when the second actuator is near the retracted position.

40. The method of claim 39, further comprising:

waiting for a predetermined period of time after the second actuator is retracted before closing the second controllable valve so that the pressure of the fluid within the second intensifier pump is increased.

41. The method of claim 40, further comprising:

sensing a position of a third actuator within the first pump, wherein the third actuator is moveable between a retracted position and an extended position;

providing data about the sensed position of the third actuator to a third controller that opens and closes a third controllable valve;

opening the third controllable valve and allowing fluid to enter the first pump when the third actuator is near the extended position; and closing the third controllable valve when the third actuator is near the retracted position.

* * * * *

UNITED STATES PATENT AND TRADEMARK OFFICE

CERTIFICATE OF CORRECTION

PATENT NO. : 6,558,134 B2
DATED : May 6, 2003
INVENTOR(S) : Mark Serafin and LeRoy C. Erickson It is certified that error appears in the above-identified patent and that said Letters Patent is hereby corrected as shown below:

Column 9,
Line 2, “front” should read -- from --.
Line 7, “refract” should read -- retract --.

Column 10,
Line 20, “refract” should read -- retract --.

Column 13,
Line 35, “wit” should read -- with --.

Signed and Sealed this

Twenty-sixth Day of July, 2005

JON W. DUDAS
*Director of the United States Patent and Trademark Office*